US012742222B2

(12) United States Patent
Jin et al.

(10) Patent No.: US 12,742,222 B2
(45) Date of Patent: Sep. 22, 2026

(54) METHOD FOR MANUFACTURING HOT-DIP GALVANIZED STEEL SHEET, AND STEEL SHEET AND VEHICLE COMPONENT

(71) Applicant: BAOSHAN IRON & STEEL CO., LTD., Shanghai (CN)

(72) Inventors: Xinyan Jin, Shanghai (CN); Yong Zhong, Shanghai (CN); Meng Chen, Shanghai (CN); Xufei Li, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 186 days.

(21) Appl. No.: 18/017,057

(22) PCT Filed: Jun. 29, 2021

(86) PCT No.: PCT/CN2021/103136
§ 371 (c)(1),
(2) Date: Jan. 19, 2023

(87) PCT Pub. No.: WO2022/017138
PCT Pub. Date: Jan. 27, 2022

(65) Prior Publication Data

US 2023/0295758 A1 Sep. 21, 2023

(30) Foreign Application Priority Data

Jul. 23, 2020 (CN) ..... 202010720177.4

(51) Int. Cl.
*C21D 9/46* (2006.01)
*C22C 38/02* (2006.01)
(Continued)

(52) U.S. Cl.
CPC ..... *C21D 9/46* (2013.01); *C22C 38/02* (2013.01); *C22C 38/04* (2013.01); *C23C 2/0222* (2022.08);
(Continued)

(58) Field of Classification Search
CPC ..... B23B 15/013; C21D 1/26; C21D 1/76; C21D 2211/001; C21D 9/46; C22C 38/02;
(Continued)

(56) References Cited

U.S. PATENT DOCUMENTS

2014/0342182 A1 11/2014 Miyata et al.
2015/0030881 A1* 1/2015 Fushiwaki ..... C23C 2/06 148/533
2019/0194770 A1 6/2019 Zhou et al.

FOREIGN PATENT DOCUMENTS

CN 101809182 A 8/2010
CN 103597102 A 2/2014
(Continued)

OTHER PUBLICATIONS

English machine translation of CN110878386A, EPO, accessed Sep. 6, 2024.*
(Continued)

*Primary Examiner* — Lois L Zheng
(74) *Attorney, Agent, or Firm* — Lei Fang, Esq.; Smith Tempel Blaha LLC

(57) ABSTRACT

The present invention provides a method for manufacturing a hot-dip galvanized steel sheet, comprising performing a heat treatment step, a hot dip plating step, and an alloying treatment step on a steel sheet having high Si and Mn content. The heat treatment step comprises a first heating phase and a soaking phase; a first heating atmosphere of the first heating stage contains 0.01-0.5% of $O_2$ by volume, and
(Continued)

the balance is $N_2$ and inevitable impurities; a soaking atmosphere of the soaking stage contains 0.5% or more of $H_2$ by volume, and the balance is $N_2$ and inevitable impurities; dew points of the first heating atmosphere and the soaking atmosphere are controlled to be ≥−20° C. the method of the present invention, a hot-dip galvanized steel sheet having both a plating layer of sufficient Fe content and a high elongation at break rate can be obtained.

17 Claims, 2 Drawing Sheets

(51) Int. Cl.

| | |
|---|---|
| ***C22C 38/04*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |
| ***C23C 8/18*** | (2006.01) |
| *C23C 8/10* | (2006.01) |

(52) U.S. Cl.
CPC ..... *C23C 2/06* (2013.01); *C23C 2/28* (2013.01); *C23C 2/40* (2013.01); *C21D 2211/001* (2013.01)

(58) Field of Classification Search
CPC ..... C22C 38/04; C23C 2/0222; C23C 2/0224; C23C 2/06; C23C 2/28; C23C 2/40
See application file for complete search history.

(56) References Cited

FOREIGN PATENT DOCUMENTS

| | | | |
|---|---|---|---|
| CN | 103814148 | A | 5/2014 |
| CN | 104245996 | A | 12/2014 |
| CN | 106661657 | A | 5/2017 |
| CN | 109906285 | A | 6/2019 |
| CN | 110878386 | A | 3/2020 |
| EP | 2840161 | A1 | 2/2015 |
| JP | 2006517257 | A | 7/2006 |
| JP | 2010215998 | A | 9/2010 |
| JP | 2010255113 | A | 11/2010 |
| JP | 2011219778 | A | 11/2011 |
| JP | 2011219779 | A | 11/2011 |
| JP | 2012149307 | A | 8/2012 |
| JP | 6085348 | B2 | 2/2017 |
| JP | 2017508866 | A | 3/2017 |
| JP | 6414371 | B | 10/2018 |
| WO | 2007/043273 | A1 | 4/2009 |
| WO | 2012/070695 | A1 | 5/2012 |
| WO | 2013/157146 | A1 | 10/2013 |

OTHER PUBLICATIONS

Supplemental EP Search Report for EP 21846555.7 dated Jun. 16, 2023.

N.N. "Standard Practice for Using Significant Digits in Test Data to Determine Conformance with Specifications", American National Standard, Jan. 1, 2013, XP055297340, West Conshohocken, PA, DOI: 10.1520/E0029-13, retrieved from the Internet: URL:http://www.galvanizeit.com/uploads/ASTM-E-29-yr-13.pdf (retrived on Aug. 24, 2016).

1st OA for JP App No. 2023-504450 dated Feb. 6, 2023.

Third Party Observation for JP 2023-504450 dated Jun. 28, 2023.

Taiwan Search Report for TW App No. 110126541 dated Jan. 12, 2022.

International Search Report for PCT/CN2021/103136 dated Sep. 24, 2021.

International Written Opinion for PCT/CN2021/103136 dated Sep. 24, 2021.

* cited by examiner

METHOD FOR MANUFACTURING HOT-DIP GALVANIZED STEEL SHEET, AND STEEL SHEET AND VEHICLE COMPONENT

CROSS-REFERENCE TO RELATED APPLICATIONS

This application is a 371 U.S. National Phase of PCT International Application No. PCT/CN2021/103136 filed on Jun. 29, 2021, which claims benefit and priority to Chinese patent application No. CN202010720177.4 filed on Jul. 23, 2020, the contents of each of the above listed applications are incorporated by reference herein in their entiries.

TECHNICAL FIELD

The present disclosure relates to a metal processing method and a product made thereby, in particular to a method for manufacturing a hot-dip galvanized steel sheet, a steel sheet and a vehicle component.

BACKGROUND ART

In recent years, there is an increasing demand for hot-dip galvanized steel sheets in the fields of automobiles, home appliances, and building materials. The method for manufacturing the hot-dip galvanized steel sheets involves sequentially performing reducing annealing, hot-dip galvanization, and alloying treatment on steel sheets. In the reducing annealing stage, some oxidized points of the steel sheet are reduced; an austenite structure is formed in the steel sheet at high temperature; and a portion of the austenite (retained austenite) remains after annealing to increase the elongation at break of the steel sheet. In the hot-dip galvanization stage, a pure zinc plating layer is formed on the steel sheet. In the alloying treatment stage, Zn in the plating layer and Fe in the steel sheet diffuse countercurrent, so that the plating layer acquires a sufficient content of Fe to form a zinc-iron alloy plating layer. After the alloying treatment, the hot-dip galvanized steel sheet acquires reliable and excellent rust resistance due to the plating layer that is not easy to peel off, so that it has been widely used in a large number of applications.

At present, in order to improve the tensile strength of a hot-dip galvanized steel sheet, it is proposed to use a steel sheet having high Si and Mn contents as a base material for the hot-dip galvanized steel sheet. However, the Si and Mn alloy elements will be enriched at the surface of the steel sheet in the form of continuous oxides during the reducing annealing process, so as to hinder the diffusion of zinc and iron, thus affecting the alloying speed. If the alloying temperature and time remain unchanged, the Fe content in the plating layer of the alloyed steel sheet will be insufficient. If the alloying temperature is increased or the alloying time is prolonged to guarantee the Fe content in the plating layer, the stability of the retained austenite will be destroyed, so that the proportion of the retained austenite phase in the structure of the hot-dip galvanized steel sheet will be reduced, and the elongation at break of the hot-dip galvanized steel sheet will be decreased.

Patent literature CN101809182B discloses a method for preparing a hot-dip galvanized and annealed steel sheet. The method comprises the following steps:—oxidizing the steel sheet to form an iron oxide layer at the surface of the steel sheet, and forming at least one internal oxide selected from the group consisting of Si oxide, Mn oxide, Al oxide, composite oxide containing Si and Mn, composite oxide containing Si and Al, composite oxide containing Al and Mn, and composite oxide containing Si, Mn and Al; reducing the oxidized steel sheet so as to reduce the iron oxide layer; —hot-dip galvanizing the reduced steel sheet to form a steel sheet having a zinc-based coating; and subjecting the steel sheet having a zinc-based coating to an alloying treatment to form an annealed steel sheet having a zinc plating layer. The Fe content in the plating layer of the steel sheet is insufficient, or the elongation at break of the steel sheet is too low.

In summary, there exists such a problem in the prior art that when a steel sheet having high Si and Mn contents is selected as a base material for a hot-dip galvanized steel sheet, it is difficult to obtain both a sufficient Fe content in the plating layer and a high elongation at break after alloying treatment.

SUMMARY

The present inventors have discovered that the iron oxide layer formed by the prior art method has a certain effect in suppressing enrichment of the Si and Mn alloy elements at the surface of the steel sheet, but this method is accompanied with a new problem, i.e. the iron oxide layer and the reduced iron layer each form an interface with the steel sheet matrix. The internal oxides formed from the Si and Mn alloy elements will be enriched at the interface between the iron oxide layer and the steel sheet matrix, and at the interface between the reduced iron layer and the steel sheet matrix. During the alloying process, the range in which zinc and iron diffuse includes both the surface of the steel sheet and the interface between the reduced iron layer and the steel sheet matrix. Thus, the alloying speed is affected, such that the Fe content in the plating layer of the steel sheet is insufficient, or the elongation at break of the steel sheet is too low.

In view of the above problem, an object of the present disclosure is to provide a method for manufacturing a hot-dip galvanized steel sheet, which method can not only suppress the enrichment of the Si and Mn alloy elements at the surface of the steel sheet, but also suppress the enrichment of the Si and Mn alloy elements at the interface between the iron oxide and the steel sheet matrix and the interface between the reduced iron and the steel sheet matrix, so that when a steel sheet having high Si and Mn contents is selected as a base material for the hot-dip galvanized steel sheet, both a sufficient Fe content in the plating layer and a high elongation at break can be obtained after the alloying treatment step.

In order to solve the above problem, the present inventors have conducted extensive studies in which the inventors have discovered that the level of dew point can influence the degree of enrichment of the Si and Mn alloy elements at the interface between the iron oxide and the steel sheet matrix and the interface between the reduced iron and the steel sheet matrix. Particularly, the enrichment can be suppressed by raising the dew point. Therefore, the inventors propose controlling the dew point at $\geq -20°$ C. in the process of oxidizing the steel sheet first by feeding oxygen and then reducing the steel sheet by feeding hydrogen. This can not only effectively suppress the enrichment at the surface of the steel sheet, but also effectively suppress the enrichment at the interface between the iron oxide and the steel sheet matrix and the interface between the reduced iron and the steel sheet matrix. The present inventions are thus accomplished.

According to the present disclosure, there is provided a method for manufacturing a hot-dip galvanized steel sheet, including performing a heat treatment step, a hot-dip galvanization step, and an alloying step on a base steel sheet containing 0.5% or more of Si and 0.5% or more of Mn by mass, wherein the heat treatment step include a first heating stage and a soaking stage, wherein a first heating atmosphere at the first heating stage contains 0.01-0.5% by volume of $O_2$ and a balance of $N_2$ and unavoidable impurities, wherein a soaking atmosphere at the soaking stage contains 0.5% or more by volume of $H_2$ and a balance of $N_2$ and unavoidable impurities, and wherein dew points of the first heating atmosphere and the soaking atmosphere are controlled at ≥−20° C.

Optionally, the heat treatment step further includes a second heating stage, wherein a second heating atmosphere at the second heating stage contains 0.5% or more by volume of $H_2$ and a balance of $N_2$ and unavoidable impurities, and wherein a dew point of the second heating atmosphere is controlled at ≥−20° C.

Optionally, the base steel sheet contains 0.1-0.3% C, 0.5-3.0% Si, 0.5-4.0% Mn by mass, and a balance of Fe and unavoidable impurities. In some embodiments, the base steel sheet contains 0.1-0.3% C, 0.5-1.8% Si, 2.0-4.0% Mn by mass, and a balance of Fe and unavoidable impurities.

Optionally, in the hot-dip galvanization step, the steel sheet has a temperature of 450-520° C. when it enters a zinc pot in which a plating bath has a temperature of 450-500° C. and contains 0.10-0.15% by mass of Al and a balance of Zn and unavoidable impurities; and after the hot-dip galvanization step is completed, an amount of zinc plated on each side of the steel sheet is 30-90 $g/m^2$. In some embodiments, in the hot-dip galvanization step, the steel sheet has a temperature of 450-500° C. when it enters the zinc pot.

Optionally, in the alloying treatment step, the temperature of the steel sheet is controlled at ≤500° C., and an alloying treatment time is controlled at ≤25 seconds.

Optionally, in the alloying treatment step, the temperature of the steel sheet is controlled at ≥460° C., and the alloying treatment time is controlled at ≥5 seconds.

In some embodiments, in the alloying treatment step, the temperature of the steel sheet is controlled at 460-500° C., and the alloying treatment time is controlled at 5-25 seconds.

Optionally, an exit temperature at the first heating stage is controlled at 570-750° C.

Optionally, at the soaking stage, the temperature of the steel sheet is controlled at 750-930° C., and a soaking time is controlled at 30-300 seconds.

Optionally, the first heating atmosphere contains 0.03-0.3% by volume of $O_2$.

Optionally, the second heating atmosphere and the soaking atmosphere contain ≤10% by volume of $H_2$.

Optionally, the dew points of the first heating atmosphere, the second heating atmosphere, and the soaking atmosphere are controlled at ≤30° C.

Optionally, the dew points of the first heating atmosphere, the second heating atmosphere, and the soaking atmosphere are controlled at ≥−10° C.

Optionally, the dew points of the first heating atmosphere, the second heating atmosphere, and the soaking atmosphere are controlled at ≥0° C.

A second object of the present disclosure is to provide a hot-dip galvanized steel sheet, such that when a steel sheet having high Si and Mn contents is used as a base material for the hot-dip galvanized steel sheet, both a sufficient Fe content in the plating layer and a high elongation at break can be obtained after the alloying treatment step.

In order to achieve the above object, according to the present disclosure, there is further provided a hot-dip galvanized steel sheet prepared by the above manufacturing method.

Optionally, the steel sheet comprises a zinc-iron alloy plating layer and an internal oxide layer from outside to inside, wherein the zinc-iron alloy plating layer contains 7-13% by mass of Fe; a phase proportion of retained austenite in the structure of the steel sheet is ≥5%; and the steel sheet has a tensile strength of ≥980 MPa and an elongation at break of ≥20%.

A third object of the present disclosure is to provide a vehicle component that satisfies the performance requirements of the vehicle component.

In order to achieve the above object, according to the present disclosure, there is further provided a vehicle component made of the above hot-dip galvanized steel sheet.

In the method for manufacturing a hot-dip galvanized steel sheet according to the present disclosure, the heat treatment atmosphere is controlled to not only suppress the enrichment of the Si and Mn alloy elements at the surface of the steel sheet, but also suppress the enrichment of the Si and Mn alloy elements at the interface between the iron oxide and the steel sheet matrix and the interface between the reduced iron and the steel sheet matrix, so that when a steel sheet having high Si and Mn contents is selected as a base material for the hot-dip galvanized steel sheet, a suitable steel sheet temperature and a suitable time can be selected in the alloying treatment step, which is conducive to acquisition of both a sufficient Fe content in the plating layer and a high elongation at break.

Figure 1:
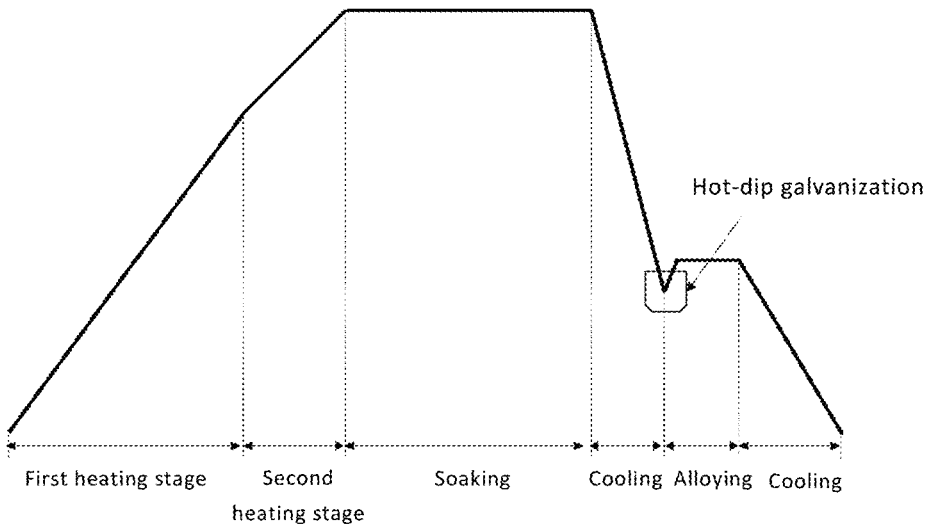
FIG. 1 is a schematic diagram of the temperature control curve in the manufacturing method provided by the present disclosure.

REFERENCE SIGNS (a). With no step being performed; (b). After the first heating stage; (c). After the second heating stage and soaking stage; (d). After the hot-dip galvanization step; (e). After the alloying treatment step.

1. Base steel sheet; 1'. Steel sheet matrix; 2. Internal oxide layer; 3. Iron oxide; 4. Reduced iron; 5. Pure zinc plating layer; 6. Zinc-iron alloy plating layer.

DETAILED DESCRIPTION

The embodiments according to the present disclosure will be illustrated with reference to the following specific examples. Those skilled in the art can readily appreciate the other advantages and efficacies of the present disclosure from the contents revealed by the specification. Although the present disclosure will be described with reference to the preferred examples, it does not mean that the features of the present disclosure are limited to these embodiments. On the contrary, the description of the present disclosure with reference to the embodiments is aimed to cover other options or modifications that may be derived based on the claims of the present disclosure. The following description contains a variety of specific details in order to provide a deep understanding of the present disclosure. The present disclosure may also be implemented without these details. In addition, some specific details will be omitted from the description in order to avoid messing up or obscuring the gist of the present disclosure.

According to the present disclosure, there is provided a method for manufacturing a hot-dip galvanized steel sheet, including performing a heat treatment step, a hot-dip galvanization step, and an alloying treatment step on a base steel sheet containing 0.5% or more of Si and 0.5% or more of Mn by mass. Heat treatment refers to a metal thermal processing process in which the material is heated, held, and cooled in a solid state to obtain the desired structure and properties. Hot-dip galvanization is a process in which a piece to be plated is immersed in a molten metal liquid to form a metal plating layer on its surface. In the present technical solution, it specifically refers to a process in which a steel sheet is immersed in a zinc liquid to form a pure zinc plating layer on its surface. In the present technical solution, the alloying treatment is a process in which the steel sheet is held at a certain temperature that is the temperature of the steel sheet in the alloying treatment step for a holding time that is the time of the alloying treatment step, and the pure zinc plating layer is allowed to become a zinc-iron alloy plating layer by the countercurrent diffusion of the iron element in the steel sheet and the zinc element in the pure zinc plating layer. The heat treatment step includes a first heating stage and a soaking stage. The first heating stage is a stage at which the steel sheet is heated from ambient temperature to a certain temperature which is an exit temperature at the first heating stage. The heating atmosphere at the first heating stage is referred to as the first heating atmosphere. The soaking stage is a stage at which the steel sheet is held at a certain temperature which is the temperature of the steel sheet at the soaking stage for a holding time which is the time of the soaking stage. The first heating atmosphere at the first heating stage contains 0.01-0.5% by volume of $O_2$ and a balance of $N_2$ and unavoidable impurities. The soaking atmosphere at the soaking stage contains 0.5% or more by volume of $H_2$ and a balance of $N_2$ and unavoidable impurities. The dew points of the first heating atmosphere and the soaking atmosphere are both controlled at ≥−20° C.

The dew point is the temperature to which air must be cooled to become saturated with water vapor, assuming constant water content and air pressure in the atmosphere, i.e. the temperature at which water vapor and water reach an equilibrium state.

After the first heating stage, due to oxidation of the base steel sheet by $O_2$ in the first heating atmosphere to form a layer of iron oxide on its surface, the internal oxide layer formed from the Si and Mn alloy elements substantially only appears under the iron oxide, thereby suppressing enrichment of the Si and Mn alloy elements at the surface of the steel sheet at the first heating stage and the soaking stage. At the same time, the high dew point allows the internal oxide layer formed from the Si and Mn alloy elements to substantially only appear in the steel sheet matrix under the iron oxide, rather than at the interface between the iron oxide and the steel sheet matrix, thereby suppressing the enrichment of the Si and Mn alloy elements at the interface between the iron oxide and the steel sheet matrix at the first heating stage. Moreover, the high dew point also contributes to suppression of the enrichment at the surface of the steel sheet.

After the soaking stage, the iron oxide is reduced to reduced iron by $H_2$ in the soaking atmosphere. During the soaking stage, the internal oxide layer formed from the Si and Mn alloy elements substantially only appears under the unreduced iron oxide and the reduced iron obtained from the reduction of the iron oxide, thereby suppressing the enrichment of the Si and Mn alloy elements at the surface of the steel sheet at the soaking stage. As a result, the effect of suppressing the enrichment at the surface of the steel sheet at the first heating stage is maintained, and preparation for the subsequent hot-dip galvanization is made. At the same time, the high dew point allows the thickness of the internal oxide layer in the steel sheet matrix to increase toward the inside of the steel sheet matrix, rather than toward the interfaces (here, the interfaces include the interface between the iron oxide and the steel sheet matrix and the interface between the reduced iron and the steel sheet matrix). As such, the enrichment at the interfaces is suppressed, and the effect of suppressing the enrichment at the interface between the iron oxide and the steel sheet matrix at the first heating stage is maintained. Moreover, the high dew point also contributes to suppression of the enrichment at the surface of the steel sheet.

When the volume fraction of $O_2$ is <0.01%, the degree of oxidation of the base steel sheet is too low to fully suppress the enrichment at the surface of the steel sheet. When the volume fraction of $O_2$ is >0.5%, the degree of oxidation of the base steel sheet is too high, which is not conducive to subsequent reduction or plating layer adhesion. Therefore, the volume fraction of $O_2$ in the first heating atmosphere is limited to 0.01-0.5%.

When the volume fraction of $H_2$ is <0.5%, the reducing effect is insufficient, which is not conducive to subsequent hot-dip galvanization. Therefore, the volume fraction of $H_2$ in the soaking atmosphere is limited to ≥0.5%. When the volume fraction of $H_2$ is ≥2%, the reducing effect is better. Hence, the volume fraction of $H_2$ in the soaking atmosphere is preferably ≥2%.

When the dew points of the atmospheres are <−20° C., the enrichment at the interface between the iron oxide and the steel sheet matrix and the interface between the reduced iron and the steel sheet matrix can hardly be suppressed at the first heating stage and the soaking stage. Therefore, the dew points of the first heating atmosphere and the soaking atmosphere are both limited to ≥−20° C.

Optionally, as shown by FIG. 1, the heat treatment step further includes a second heating stage. The second heating stage is a stage at which the steel sheet is heated from the exit temperature at the first heating stage to the temperature of the steel sheet at the soaking stage. The heating atmosphere at the second heating stage is referred to as a second heating atmosphere. The second heating atmosphere at the second heating stage contains 0.5% or more by volume of $H_2$ and a balance of $N_2$ and unavoidable impurities. The dew point of the second heating atmosphere is controlled at ≥−20° C.

The method for manufacturing the hot-dip galvanized steel sheet further includes a first cooling stage and a second cooling stage. At the first cooling stage, the steel sheet is cooled from the temperature of the steel sheet at the soaking stage to the temperature of the steel sheet entering the zinc pot. At the second cooling stage, the steel sheet is cooled from the temperature of the steel sheet at the alloying treatment step to ambient temperature.

Figure 2:
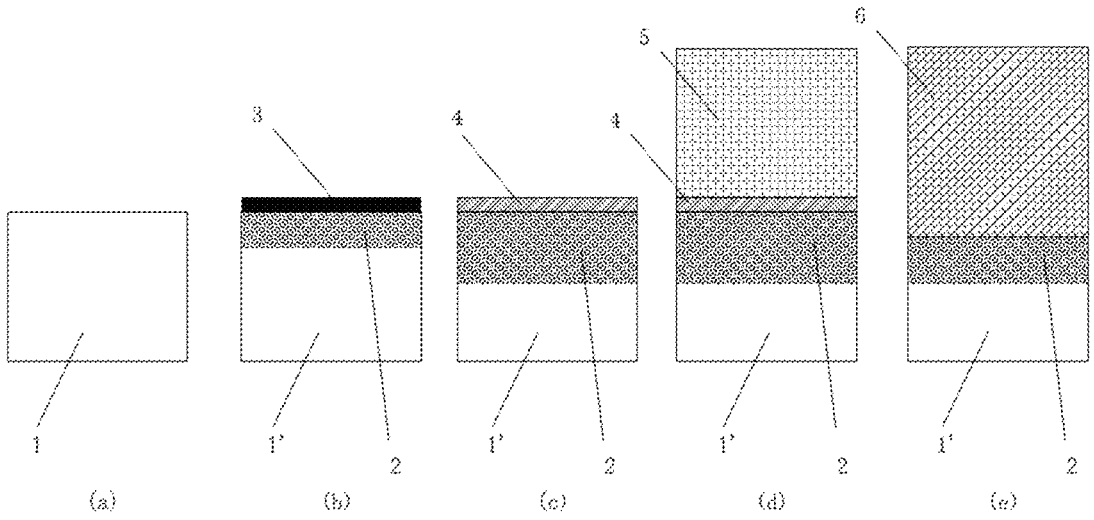
FIG. 2 is a schematic view showing the cross-section of the steel sheet after each step of the manufacturing method provided by the present disclosure.

As shown by FIG. 2, after the first heating stage, the cross-section of the steel sheet changes from the one shown by FIG. 2(*a*) to the one shown by FIG. 2(*b*). Due to oxidation of the base steel sheet 1 by $O_2$ in the first heating atmosphere to form a layer of iron oxide 3 on its surface, the internal oxide layer 2 formed from the Si and Mn alloy elements substantially only appears under the iron oxide 3, thereby suppressing the enrichment of the Si and Mn alloy elements at the surface of the steel sheet at the first heating stage, the second heating stage and the soaking stage. At the same time, the high dew point allows the internal oxide layer 2 formed from the Si and Mn alloy elements to substantially only appear in the steel sheet matrix 1' under the iron oxide 3, rather than at the interface between the iron oxide 3 and the steel sheet matrix 1', thereby suppressing the enrichment of the Si and Mn alloy elements at the interface between the iron oxide 3 and the steel sheet matrix 1' at the first heating stage. Moreover, the high dew point also contributes to suppression of the enrichment at the surface of the steel sheet.

After the second heating stage and the soaking stage, the cross-section of the steel sheet changes from the one shown by FIG. 2(*b*) to the one shown by FIG. 2(*c*). The iron oxide 3 is reduced to reduced iron 4 by $H_2$ in the second heating atmosphere and the soaking atmosphere. During the second heating stage and the soaking stage, the internal oxide layer 2 formed from the Si and Mn alloy elements substantially only appears under the unreduced iron oxide 3 and the reduced iron 4 obtained from the reduction of the iron oxide 3, thereby suppressing the enrichment of the Si and Mn alloy elements at the surface of the steel sheet at the second heating stage and the soaking stage. As a result, the effect of suppressing the enrichment at the surface of the steel sheet at the first heating stage is maintained, and preparation for the subsequent hot-dip galvanization is made. At the same time, the high dew point allows the thickness of the internal oxide layer 2 in the steel sheet matrix 1' to increase toward the inside of the steel sheet matrix 1', rather than toward the interfaces (here, the interfaces include the interface between the iron oxide 3 and the steel sheet matrix 1' and the interface between the reduced iron 4 and the steel sheet matrix 1'). As such, the enrichment at the interfaces is suppressed, and the effect of suppressing the enrichment at the interface between the iron oxide 3 and the steel sheet matrix 1' at the first heating stage is maintained. Moreover, the high dew point also contributes to suppression of the enrichment at the surface of the steel sheet.

When the volume fraction of $O_2$ is <0.01%, the degree of oxidation of the base steel sheet 1 is too low to fully suppress the enrichment at the surface of the steel sheet. When the volume fraction of $O_2$ is >0.5%, the degree of oxidation of the base steel sheet 1 is too high, which is not conducive to subsequent reduction or plating layer adhesion. Therefore, the volume fraction of $O_2$ in the first heating atmosphere is limited to 0.01-0.5%.

When the volume fraction of $H_2$ is <0.5%, the reducing effect is insufficient, which is not conducive to the subsequent hot-dip galvanization. Therefore, the volume fraction of $H_2$ in the second heating atmosphere and the soaking atmosphere is limited to ≥0.5%. When the volume fraction of $H_2$ is ≥2%, the reducing effect is better. Hence, the volume fraction of $H_2$ in the second heating atmosphere and the soaking atmosphere is preferably ≥2%.

When the dew points of the atmospheres are <−20° C., the enrichment at the interface between the iron oxide 3 and the steel sheet matrix 1' and the interface between the reduced iron 4 and the steel sheet matrix 1' can hardly be suppressed at the first heating stage, the second heating stage and the soaking stage. Therefore, the dew points of the first heating atmosphere, the second heating atmosphere and the soaking atmosphere are all limited to ≥−20° C.

Optionally, the base steel sheet 1 contains 0.1-0.3% C, 0.5-3.0% Si, 0.5-4.0% Mn by mass, and a balance of Fe and unavoidable impurities.

When the mass fraction of C in the base steel sheet 1 is <0.1%, the tensile strength of the steel sheet is insufficient; and when the mass fraction of C in the base steel sheet 1 is >0.3%, the weldability of the steel sheet is deteriorated. Therefore, the mass fraction of C is limited to 0.1-0.3%. When the mass fraction of Si in the base steel sheet 1 is <0.5%, the tensile strength and the elongation at break of the steel sheet are insufficient; and when the mass fraction of Si in the base steel sheet 1 is >3.0%, the high-temperature plasticity of the steel sheet is insufficient, and the incidence rate of defects during processing is increased. Therefore, the mass fraction of Si is limited to 0.5-3.0%. In some embodiments, the mass fraction of Si in the base steel sheet is 0.5-1.8%. When the mass fraction of Mn in the base steel sheet 1 is <0.5%, the tensile strength and the elongation at break of the steel sheet are insufficient; and when the mass fraction of Mn in the base steel sheet 1 is >4.0%, the hardenability of the steel sheet is too high, which is not conducive to fine control of the structure. Therefore, the mass fraction of Mn is limited to 0.5-4.0%. In some embodiments, the mass fraction of Mn in the base steel sheet is 2.0-4.0%.

Optionally, in the hot-dip galvanization step, the steel sheet has a temperature of 450-520° C. when it enters the zinc pot. The plating bath has a temperature of 450-500° C. The plating bath contains 0.10-0.15% by mass of Al and a balance of Zn and unavoidable impurities. After the hot-dip galvanization step is completed, the amount of zinc plated on each side of the steel sheet is 30-90 g/m$^2$.

After the hot-dip galvanization, the cross-section of the steel sheet changes from the one shown by FIG. 2(*c*) to the one shown in FIG. 2(*d*). A pure zinc plating layer 5 is formed on the steel sheet. The temperature of the steel sheet entering the zinc pot and the temperature of the plating bath have an influence on the reaction between the steel sheet and the plating bath. When the temperature of the steel sheet entering the zinc pot and the temperature of the plating bath are too low, the reaction rate is slow, and the efficiency is reduced. When the temperature of the steel sheet entering the zinc pot and the temperature of the plating bath are too high, the reaction rate is too fast, and an "out-burst structure" is formed, which is not conducive to control of the Fe content in the plating layer in the subsequent alloying process. Therefore, in the hot-dip galvanization, the temperature of the steel sheet entering the zinc pot is limited to 450-520° C., and the temperature of the plating bath is limited to 450-500° C. When the temperature of the steel sheet entering the zinc pot is 470-500° C., and the temperature of the plating bath is 460-480° C., the reaction rate is moderate. Therefore, it's preferred that the temperature of the steel sheet entering the zinc pot is 470-500° C., and the temperature of the plating bath is 460-480° C. The plating bath contains 0.10-0.15% by mass of Al, preferably 0.10-0.12% by mass of Al. When the hot-dip galvanization step is completed, if the amount of zinc plated on each side of the steel sheet is <30 g/m$^2$, the corrosion resistance will be poor; if the amount of zinc plated on each side is >90 g/m$^2$, the zinc-iron alloy plating layer 6 has poor formability, is prone to powdering and peeling off and will affect the alloying process, not conducive to acquisition of both a sufficient Fe content in the plating layer and a high elongation at break of the steel sheet. Therefore, the amount of zinc plated on each side of the steel sheet after the completion of the hot-dip galvanization step is limited to 30-90 g/$m^2$.

Optionally, in the alloying treatment step, the temperature of the steel sheet is controlled at ≤500° C., and the time is controlled at ≤25 seconds.

After the alloying treatment, the cross-section of the steel sheet changes from the one shown by FIG. 2(*d*) to the one shown by FIG. 2(*e*). During the alloying treatment, Zn in the pure zinc plating layer 5 and Fe in the steel sheet matrix 1' diffuse countercurrent, so that a zinc-iron alloy plating layer 6 is formed on the steel sheet. The temperature of the steel sheet and the time used in the alloying treatment step both have an influence on the stability of the retained austenite and the Fe content in the plating layer. When the temperature of the steel sheet is >500° C. or the time is >25 seconds, the stability of the retained austenite in the steel sheet is decreased, and the phase proportion of the retained austenite is reduced, thereby reducing the elongation at break of the steel sheet. In addition, zinc and iron will diffuse excessively, so that the powdering resistance of the zinc-iron alloy plating layer 6 will be exasperated. Therefore, the temperature of the steel sheet in the alloying treatment step is limited to ≤500° C., and the time is limited to ≤25 seconds. Because the phase proportion of the retained austenite in the steel sheet will be higher, and the elongation at break of the steel sheet will also be higher when the temperature of the steel sheet is ≤480° C. and the time is ≤20 seconds, it's preferred that the temperature of the steel sheet in the alloying treatment step is ≤480° C., and the time is ≤20 seconds.

Optionally, in the alloying treatment step, the temperature of the steel sheet is controlled at ≥460° C., and the time is controlled at ≥5 seconds.

The temperature of the steel sheet and the time used in the alloying treatment step both have an influence on the Fe content in the plating layer. When the temperature is <460° C. or the time is <5 seconds, the diffusion of zinc and iron will be insufficient, so that the Fe content in the plating layer will be not enough. Therefore, the temperature of the steel sheet in the alloying treatment step is limited to ≥460° C., and the time is limited to ≥5 seconds.

Optionally, the exit temperature at the first heating stage is controlled at 570-750° C.

The exit temperature has an influence on the degree of oxidation of the base steel sheet 1. When the temperature is <570° C., the degree of oxidation of the base steel sheet 1 is too low to fully suppress the enrichment at the surface of the steel sheet. When the temperature is >750° C., the degree of oxidation of the base steel sheet 1 is too high, which is not conducive to subsequent reduction or plating layer adhesion. Therefore, the exit temperature at the first heating stage is limited to 570-750° C. When the exit temperature is 600-720° C., the degree of oxidation is moderate. Therefore, it's preferred that the exit temperature at the first heating stage is 600-720° C.

Optionally, at the soaking stage, the temperature of the steel sheet is controlled at 750-930° C., and the time is controlled at 30-300 seconds.

The temperature of the steel sheet at the soaking stage has an influence on the formation of austenite. When the temperature of the steel sheet is <750° C., the austenitization of the steel sheet is insufficient. When the temperature of the steel sheet is >930° C., coarse austenite grains will form in the steel sheet, which is not conducive to the performances of the steel sheet. Therefore, the temperature of the steel sheet at the soaking stage is limited to 750-930° C. When the time of the soaking stage is <30 seconds, the austenitization of the steel sheet is insufficient; and when the time of the soaking stage is >300 seconds, the production efficiency is affected. Therefore, the time of the soaking stage is limited to 30-300 seconds.

Optionally, the volume fraction of $O_2$ in the first heating atmosphere is 0.03-0.3%.

When the volume fraction of $O_2$ in the first heating atmosphere is 0.03-0.3%, the degree of oxidation of the base steel sheet 1 is more moderate. Therefore, the volume fraction of $O_2$ in the first heating atmosphere is preferably 0.03-0.3%.

Optionally, the volume fraction of $H_2$ in each of the second heating atmosphere and the soaking atmosphere is ≤10%.

After the volume fraction of $H_2$ in each of the second heating atmosphere and the soaking atmosphere reaches >10%, its effect in reducing the iron oxide 3 will no longer increase. Therefore, the volume fraction of $H_2$ in each of the second heating atmosphere and the soaking atmosphere is limited to ≤10% from an economic point of view.

In some embodiments, the volume fraction of $H_2$ in each of the second heating atmosphere and the soaking atmosphere is limited to 0.5-10%, preferably 2-10%.

Optionally, the dew points of the first heating atmosphere, the second heating atmosphere, and the soaking atmosphere are controlled at ≤30° C.

After the dew points reach >30° C., the effect in suppressing the enrichment at the interface between the iron oxide 3 and the steel sheet matrix 1' and the interface between the reduced iron 4 and the steel sheet matrix 1 no longer increases. Therefore, the dew points of the first heating atmosphere, the second heating atmosphere, and the soaking atmosphere are limited to ≤30° C.

Optionally, the dew points of the first heating atmosphere, the second heating atmosphere, and the soaking atmosphere are controlled at ≥−10° C.

When the dew points of the atmospheres are ≥−10° C., the effect in suppressing the enrichment at the interface between the iron oxide 3 and the steel sheet matrix 1' and the interface between the reduced iron 4 and the steel sheet matrix 1' is obvious. Therefore, the dew points of the first heating atmosphere, the second heating atmosphere, and the soaking atmosphere are preferably ≥−10° C.

Optionally, the dew points of the first heating atmosphere, the second heating atmosphere, and the soaking atmosphere are controlled at ≥0° C.

When the dew points of the atmospheres are ≥0° C., the effect in suppressing the enrichment at the interface between the iron oxide 3 and the steel sheet matrix 1' and the interface between the reduced iron 4 and the steel sheet matrix 1' is more obvious. Therefore, the dew points of the first heating atmosphere, the second heating atmosphere, and the soaking atmosphere are more preferably ≥0° C.

In some embodiments, the dew points of the first heating atmosphere, the second heating atmosphere, and the soaking atmosphere are −20° C. to 30° C. In some embodiments, the dew points of the first heating atmosphere, the second heating atmosphere, and the soaking atmosphere are −10° C. to 30° C. In some embodiments, the dew points of the first heating atmosphere, the second heating atmosphere, and the soaking atmosphere are 0° C. to 30° C.

According to the present disclosure, there is further provided a hot-dip galvanized steel sheet prepared by the above manufacturing method.

Optionally, the steel sheet comprises a zinc-iron alloy plating layer 6 and an internal oxide layer 2, wherein the zinc-iron alloy plating layer 6 contains 7-13% by mass of Fe; the phase proportion of the retained austenite in the structure is ≥5%; and the steel sheet has a tensile strength of ≥980 MPa and an elongation at break of ≥20%.

According to the present disclosure, there is further provided a vehicle component made of the above hot-dip galvanized steel sheet.

EXAMPLES

Examples 1-11 and Comparative Examples 1-6

The base steel sheets having the compositions shown in Table 1 were selected to manufacture the hot-dip galvanized steel sheets of Examples 1-11 and Comparative Examples 1-6 by the following manufacturing method.

(1) First heating stage: the base steel sheet was heated from ambient temperature to the exit temperature, wherein the atmosphere was $O_2$ atmosphere with the balance being $N_2$ and unavoidable impurities, and the dew point was controlled.

(2) Second heating stage: the steel sheet was heated from the exit temperature to the temperature of the steel sheet at the soaking stage, wherein the atmosphere was $H_2$ atmosphere with the balance being $N_2$ and unavoidable impurities, and the dew point was controlled.

(3) Soaking stage: the steel sheet was held at the temperature of the steel sheet at the soaking stage, wherein the atmosphere was $H_2$ atmosphere with the balance being $N_2$ and unavoidable impurities, and the dew point was controlled.

(4) First cooling stage: the steel sheet was cooled from the temperature of the steel sheet at the soaking stage to the temperature of the steel sheet entering a zinc pot, and the cooling rate was ≥10° C./s.

(5) Hot-dip galvanization: the steel sheet was immersed in a plating bath held at the temperature of the plating bath, wherein the plating bath contained Al and a balance of Zn and unavoidable impurities, wherein the amount of zinc plated on each side of the steel sheet was 30-90 g/m$^2$ after the hot-dip galvanization was completed.

(6) Alloying treatment: after the hot-dip galvanization, the steel sheet was held at the temperature of the steel sheet in the alloying treatment step to form a zinc-iron alloy plating layer.

(7) Second cooling stage: the steel sheet was cooled from the temperature of the steel sheet in the alloying treatment step to ambient temperature.

Comparative Example 7

The base steel sheet having the composition shown in Table 1 was selected to manufacture the hot-dip galvanized steel sheet of Comparative Example 7 by the following manufacturing method.

(1) First and second heating stages: the base steel sheet was heated from ambient temperature to the temperature of the steel sheet at the soaking stage, wherein the atmosphere was $H_2$ atmosphere with the balance being $N_2$ and unavoidable impurities, and the dew point was controlled.

(2)-(6) were the same as (3)-(7) in the manufacturing method for Examples 1-11 and Comparative Examples 1-6.

Performance Test Methods:

Performance tests were performed on the hot-dip galvanized steel sheets according to the description in the following test methods. The test results are shown in Table 1:

(1) Tensile Strength (MPa)

The test was performed using a universal tensile testing machine according to the method described in GB/T 228.1-2010.

(2) Elongation at Break (%)

The test was performed using a universal tensile testing machine according to the method described in GB/T 228.1-2010.

(3) Fe Content in Plating Layer (%)

A disc having a diameter of 50 mm was punched from a steel sheet and used as a sample to be tested. The plating layer was dissolved in a 10 vol. % hydrochloric acid solution to which a hexamethylenetetramine corrosion inhibitor was added, and the Fe content was determined by the ICP-AES method.

(4) Phase Proportion of Austenite (%)

After the cross-sectional metallography was prepared, the phases were identified and analyzed quantitatively using a scanning electron microscope-based electron backscatter diffraction (EBSD) device, and the phase proportion of the retained austenite was calculated.

Figure 3:
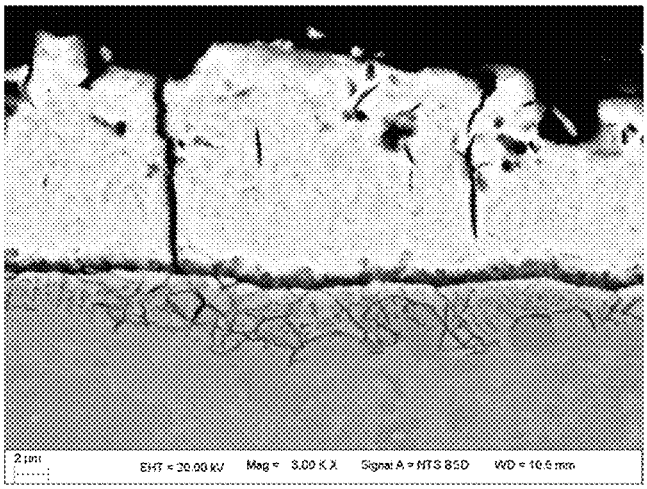
FIG. 3 is a metallographic photograph of the cross-section of the hot-dip galvanized steel sheet obtained in Example 1.
Figure 4:
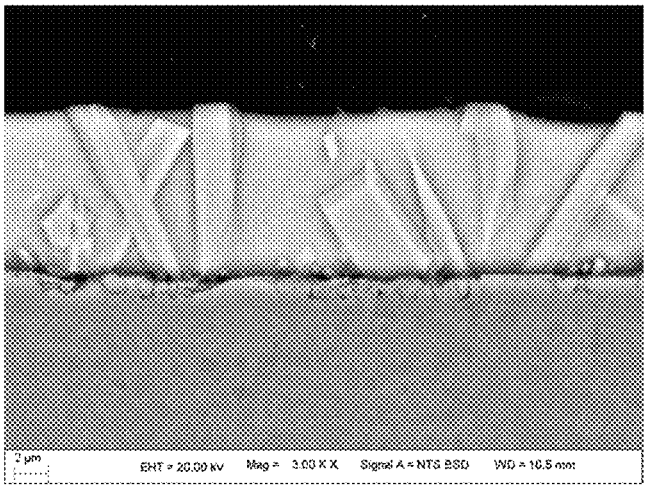
FIG. 4 is a metallographic photograph of the cross-section of the hot-dip galvanized steel sheet obtained in Comparative Example 7.

The method for taking metallographic photos:

According to the description in the following photographing method, metallographic photographs were taken for the hot-dip galvanized steel sheets. The photographs are shown in FIGS. 3 and 4.

After the cross-sectional metallography was prepared, photographs were taken using a metallographic microscope.

TABLE 1

Base material compositions of hot-dip galvanized steel sheets, manufacture method and performances

| | Base steel sheet composition | | | First heating stage | | | | Second heating stage | | Soaking | | | |
|---|---|---|---|---|---|---|---|---|---|---|---|---|---|
| No. | C/ % | Si/ % | Mn/ % | $O_2$ content % | $H_2$ content/ % | Dew point/ ° C. | Exit temperature/ ° C. | $H_2$ content/ % | Dew point/ ° C. | $H_2$ content/ % | Dew point/ ° C. | Steel sheet temperature/ ° C. | Time/ s |
| Ex. 1 | 0.2 | 1.8 | 2.0 | 0.1 | 0 | 10 | 700 | 5 | 0 | 5 | 0 | 840 | 120 |
| Ex. 2 | 0.2 | 1.8 | 2.0 | 0.1 | 0 | −10 | 700 | 2.5 | 10 | 2.5 | 10 | 840 | 120 |
| Ex. 3 | 0.2 | 1.8 | 2.0 | 0.03 | 0 | 30 | 750 | 10 | −5 | 10 | −5 | 850 | 300 |
| Ex. 4 | 0.2 | 1.8 | 2.0 | 0.1 | 0 | −20 | 740 | 10 | −5 | 10 | −10 | 850 | 200 |
| Ex. 5 | 0.2 | 1.8 | 2.0 | 0.01 | 0 | 0 | 700 | 0.5 | −10 | 0.5 | −15 | 830 | 60 |
| Ex. 6 | 0.1 | 0.5 | 4.0 | 0.06 | 0 | 20 | 600 | 5 | 0 | 5 | 0 | 930 | 120 |
| Ex. 7 | 0.1 | 1.8 | 3.0 | 0.11 | 0 | 15 | 700 | 2 | 30 | 2 | 30 | 820 | 120 |
| Ex. 8 | 0.3 | 0.5 | 2.0 | 0.02 | 0 | 0 | 570 | 2 | 10 | 2 | 10 | 840 | 60 |
| Ex. 9 | 0.25 | 1.0 | 2.5 | 0.5 | 0 | 25 | 720 | 2 | 5 | 2 | 5 | 834 | 180 |
| Ex. 10 | 0.2 | 1.8 | 2.0 | 0.2 | 0 | 5 | 700 | 5 | −20 | 5 | −20 | 850 | 120 |
| Ex. 11 | 0.12 | 1.0 | 2.0 | 0.3 | 0 | 0 | 680 | 5 | 0 | 5 | 0 | 750 | 30 |

TABLE 1-continued

Base material compositions of hot-dip galvanized steel sheets, manufacture method and performances

| | | | | | | | | | | | | | |
|---|---|---|---|---|---|---|---|---|---|---|---|---|---|
| Comp. Ex. 1 | 0.2 | 1.8 | 2.0 | 0.005 | 0 | 10 | 700 | 2 | 10 | 2 | 10 | 850 | 120 |
| Comp. Ex. 2 | 0.2 | 1.8 | 2.0 | 0.1 | 0 | −30 | 640 | 2 | −10 | 2 | −10 | 850 | 120 |
| Comp. Ex. 3 | 0.2 | 1.8 | 2.0 | 0.12 | 0 | −10 | 550 | 2 | 0 | 2 | 0 | 850 | 120 |
| Comp. Ex. 4 | 0.2 | 1.8 | 2.0 | 0.6 | 0 | 0 | 650 | 5 | 0 | 5 | 0 | 830 | 120 |
| Comp. Ex. 5 | 0.2 | 1.8 | 2.0 | 0.05 | 0 | −10 | 700 | 2 | −25 | 2 | −15 | 850 | 120 |
| Comp. Ex. 6 | 0.2 | 1.8 | 2.0 | 0.05 | 0 | −10 | 700 | 2 | −20 | 2 | −25 | 850 | 120 |
| Comp. Ex. 7 | 0.2 | 1.8 | 2.0 | 0 | 2 | −20 | / | 2 | −20 | 2 | −20 | 850 | 120 |

| | Hot-dip galvanization | | | | | Performances | | |
|---|---|---|---|---|---|---|---|---|
| | Temperature of steel | Plating | Al content | Alloying | | | | Fe content |
| No. | sheet entering zinc pot/ ° C. | bath temperature/ ° C. | in plating bath/ % | Steel sheet temperature/ ° C. | Time/ s | Tensile strength/ Mpa | Elongation at break/ % | in plating layer/ % |
| Ex. 1 | 465 | 460 | 0.11 | 490 | 15 | 1089 | 22.9 | 7.8 |
| Ex. 2 | 470 | 450 | 0.11 | 470 | 10 | 1054 | 24.3 | 7.4 |
| Ex. 3 | 460 | 460 | 0.11 | 460 | 20 | 1049 | 23.2 | 9.5 |
| Ex. 4 | 460 | 460 | 0.11 | 495 | 25 | 1077 | 22 | 8.7 |
| Ex. 5 | 460 | 460 | 0.10 | 490 | 25 | 1058 | 21.7 | 7.5 |
| Ex. 6 | 520 | 480 | 0.13 | 500 | 20 | 1021 | 20.3 | 9.9 |
| Ex. 7 | 461 | 465 | 0.12 | 490 | 25 | 1099 | 22.4 | 12.7 |
| Ex. 8 | 450 | 460 | 0.15 | 500 | 5 | 998 | 21.6 | 9.8 |
| Ex. 9 | 500 | 500 | 0.13 | 500 | 25 | 1078 | 20.2 | 8.6 |
| Ex. 10 | 470 | 465 | 0.14 | 498 | 20 | 1066 | 20.5 | 7.3 |
| Ex. 11 | 465 | 460 | 0.13 | 480 | 15 | 1052 | 27 | 11.8 |
| Comp. Ex. 1 | 460 | 460 | 0.12 | 550 | 30 | 1096 | 17 | 8.4 |
| Comp. Ex. 2 | 460 | 460 | 0.12 | 530 | 15 | 1061 | 14.7 | 3.7 |
| Comp. Ex. 3 | 470 | 465 | 0.11 | 500 | 25 | 1073 | 21.1 | 5.2 |
| Comp. Ex. 4 | 460 | 360 | 0.11 | 510 | 20 | 1079 | 18.8 | 2.5 |
| Comp. Ex. 5 | 470 | 465 | 0.11 | 500 | 25 | 1070 | 20.1 | 3.4 |
| Comp. Ex. 6 | 470 | 465 | 0.11 | 500 | 25 | 1038 | 21.2 | 2.8 |
| Comp. Ex. 7 | 460 | 460 | 0.12 | 550 | 20 | 1082 | 16 | 2.3 |

Note:
the chemical compositions of the base steel sheets are all based on mass, the balance being Fe and unavoidable impurities; the gas contents are all based on volume; the Al contents in the plating bath are based on mass; and the Fe contents in the plating layers are based on mass.

The results are shown in Table 1. As it can be seen from Examples 1-11, the tensile strength of the hot-dip galvanized steel sheet obtained by the manufacturing method according to the present disclosure is ≥980 Mpa; the Fe content in the plating layer is in the range of 7-13% by mass; and the elongation at break is ≥20%. With the use of a steel sheet having high Si and Mn contents as a base material, while a high tensile strength is obtained, both a sufficient Fe content in the plating layer and a high elongation at break are obtained. FIG. 3 is a cross-sectional metallographic photograph of the hot-dip galvanized steel sheet obtained in Example 1. As it can be seen, the alloying of the zinc-iron alloy plating layer is sufficient, and the internal oxide layer formed from the Si and Mn alloy elements is relatively thick, indicating that the degree of the enrichment at the surface of the steel sheet, at the interface between the iron oxide and the steel sheet matrix, and at the interface between the reduced iron and the steel sheet matrix is low.

As regards Comparative Example 1, the $O_2$ content at the first heating stage was insufficient, so that the degree of oxidation of the base steel sheet was insufficient. As a result, the effect of the iron oxide in suppressing the enrichment of the Si and Mn alloying elements at the surface of the steel sheet was poor. The Si and Mn alloying elements formed continuous oxides at the surface of the steel sheet, which affected the alloying speed. Therefore, the alloying temperature was increased to 550° C., and the alloying time was extended to 30 s. Consequently, the austenite content was reduced, and the elongation at break of the steel sheet was only 17%.

As regards Comparative Example 2, the dew point at the first heating stage was too low, namely −30° C., so that the effect of the dew point in suppressing the enrichment of the Si and Mn alloy elements was deteriorated, especially the enrichment at the interface between the iron oxide and the steel sheet matrix. The Si and Mn alloy elements formed continuous oxides at this interface, which affected the alloying speed. Therefore, the alloying temperature was increased to 530° C. Consequently, the austenite content was reduced; the elongation at break of the steel sheet was only 14.7%; and the iron content in the plating layer was still only 3.7%.

As regards Comparative Example 3, the exit temperature at the first heating stage was too low, only 550° C., so that the degree of oxidation of the base steel sheet was insufficient, and the effect of the iron oxide in suppressing the enrichment of the Si and Mn alloy elements at the surface of the steel sheet was poor. The Si and Mn alloy elements formed continuous oxides at the surface of the steel sheet, which affected the alloying speed. The iron content in the plating layer was only 5.2%.

As regards Comparative Example 4, the $O_2$ content at the first heating stage was too high, so that the degree of oxidation of the base steel sheet was too high. As a result, subsequent reduction was incomplete, and the plating layer adhesion was poor. At the same time, the temperature of the plating bath in the hot-dip galvanization step was too low, only 360° C., so that the reaction between the plating bath and the steel sheet was not good. The alloying temperature was increased to 510° C., which reduced the austenite content. The elongation at break of the steel sheet was only 18.8%, and the iron content in the plating layer was still only 2.5%.

As regards Comparative Example 5, the dew point at the second heating stage was too low, namely −25° C., so that the effect of the dew point in suppressing the enrichment of the Si and Mn alloy elements was deteriorated, especially the enrichment at the interfaces (here, the interfaces include the interface between the iron oxide and the steel sheet matrix and the interface between the reduced iron and the steel sheet matrix). The Si and Mn alloy elements formed continuous oxides at these interfaces, which affected the alloying speed. So, the iron content in the plating layer was only 3.4%.

As regards Comparative Example 6, the dew point at the soaking stage was too low, namely −25° C., so that the effect of the dew point in suppressing the enrichment of the Si and Mn alloy elements was deteriorated, especially the enrichment at the interfaces (here, the interfaces include the interface between the iron oxide and the steel sheet matrix and the interface between the reduced iron and the steel sheet matrix). The Si and Mn alloy elements formed continuous oxides at these interfaces, which affected the alloying speed. So, the iron content in the plating layer was only 2.8%.

As regards Comparative Example 7, the atmosphere at the first heating stage was $H_2$ atmosphere instead of $O_2$ atmosphere, so that no iron oxide layer was formed, and there was no interface between the steel sheet matrix and iron oxide or reduced iron. Therefore, the enrichment of the Si and Mn alloy elements was not suppressed, which affected the alloying speed. Hence, the alloying temperature was increased to 550° C. Consequently, the austenite content was reduced. The elongation at break of the steel sheet was only 16%, and the iron content in the plating layer was still only 2.3%. FIG. 4 is the cross-sectional metallographic photograph of the hot-dip galvanized steel sheet obtained in Comparative Example 7. As it can be seen, the alloying of the zinc-iron alloy plating layer was insufficient, and the internal oxide layer formed from the Si and Mn alloy elements was relatively thin, indicating a relatively high degree of enrichment at the surface of the steel sheet.

In summary, in the method for manufacturing a hot-dip galvanized steel sheet according to the present disclosure, the atmospheres at the heating and soaking stages are controlled to not only suppress the enrichment of the Si and Mn alloy elements at the surface of the hot-dip galvanized steel sheet, but also suppress the enrichment of the Si and Mn alloy elements at the interface between the iron oxide and the steel sheet matrix and the interface between the reduced iron and the steel sheet matrix, so that when a steel sheet having high Si and Mn contents is selected as a base material for the hot-dip galvanized steel sheet, a suitable steel sheet temperature and a suitable time can be selected in the alloying treatment step, which is conducive to acquisition of both a sufficient Fe content in the plating layer and a high elongation at break. The hot-dip galvanized steel sheet is suitable for vehicle components.

The above Examples are only intended to provide exemplary illustration of the principle and efficacies of the present disclosure, not to limit the present disclosure. Any person skilled in the art can modify or change the above Examples without departing from the spirit and scope of the present disclosure. Therefore, all equivalent modifications or changes made by those skilled in the art without departing from the spirit and technical ideas disclosed in the present disclosure should still be covered by the claims of the present disclosure.

What is claimed is:

1. A manufacturing method for a hot-dip galvanized steel sheet, including performing sequentially a heat treatment step, a hot-dip galvanization step, and an alloying treatment step on a base steel sheet containing 0.5% or more of Si and 0.5% or more of Mn by mass, wherein:

the heat treatment step includes a first heating stage and a soaking stage, wherein:

a first heating atmosphere at the first heating stage consists of 0.01-0.5% by volume of $O_2$ and a balance of $N_2$ and unavoidable impurities; a soaking atmosphere at the soaking stage contains 0.5% or more by volume of $H_2$ and a balance of $N_2$ and unavoidable impurities; and dew points of the first heating atmosphere and the soaking atmosphere are controlled at ≥−20° C., and wherein after the first heating stage, $O_2$ in the first heating atmosphere oxidize the base steel sheet to form a layer of iron oxide on its surface.

2. The manufacturing method according to claim 1, wherein the heat treatment step further includes a second heating stage, wherein a second heating atmosphere at the second heating stage contains 0.5% or more by volume of $H_2$ and a balance of $N_2$ and unavoidable impurities, and wherein a dew point of the second heating atmosphere is controlled at ≥−20° C.

3. The manufacturing method according to claim 1, wherein the base steel sheet contains 0.1-0.3% C, 0.5-3.0% Si, 0.5-4.0% Mn by mass, and a balance of Fe and unavoidable impurities.

4. The manufacturing method according to claim 1, wherein at the hot-dip galvanization step, the steel sheet has a temperature of 450-520° C. when it enters a zinc pot in which a plating bath has a temperature of 450-500° C. and contains 0.10-0.15% by mass of Al and a balance of Zn and unavoidable impurities, wherein after the hot-dip galvanization step is completed, an amount of zinc plated on each side of the steel sheet is 30-90 $g/m^2$.

5. The manufacturing method according to claim 1, wherein in the alloying treatment step, the temperature of the steel sheet is controlled at ≤500° C., and an alloying treatment time is controlled at ≤25 seconds.

6. The manufacturing method according to claim 5, wherein in the alloying treatment step, the temperature of the steel sheet is controlled at ≥460° C., and the alloying treatment time is controlled at ≥5 seconds.

7. The manufacturing method according to claim 1, wherein an exit temperature at the first heating stage is controlled at 570-750° C.

8. The manufacturing method according to claim 1, wherein at the soaking stage, the temperature of the steel sheet is controlled at 750-930° C., and a soaking time is controlled at 30-300 seconds.

9. The manufacturing method according to claim 1, wherein the first heating atmosphere at the first heating stage consists of 0.03-0.3% by volume of $O_2$ and a balance of $N_2$ and unavoidable impurities.

10. The manufacturing method according to claim 2, wherein the second heating atmosphere and the soaking atmosphere contain≤10% by volume of $H_2$.

11. The manufacturing method according to claim 2, wherein the dew points of the first heating atmosphere, the second heating atmosphere, and the soaking atmosphere are controlled at ≤30° C.

12. The manufacturing method according to claim 2, wherein the dew points of the first heating atmosphere, the second heating atmosphere, and the soaking atmosphere are controlled at ≥−10° C.

13. The manufacturing method according to claim 2, wherein the dew points of the first heating atmosphere, the second heating atmosphere, and the soaking atmosphere are controlled at ≥0° C.

14. The manufacturing method according to claim 2, wherein at the hot-dip galvanization step, the steel sheet has a temperature of 450-520° C. when it enters a zinc pot in which a plating bath has a temperature of 450-500° C. and contains 0.10-0.15% by mass of Al and a balance of Zn and unavoidable impurities, wherein after the hot-dip galvanization step is completed, an amount of zinc plated on each side of the steel sheet is 30-90 $g/m^2$.

15. The manufacturing method according to claim 2, wherein in the alloying treatment step, the temperature of the steel sheet is controlled at a range of 460~500° C., and an alloying treatment time is controlled at a range of 5~25 seconds.

16. The manufacturing method according to claim 2, wherein an exit temperature at the first heating stage is controlled at 570-750° C.

17. The manufacturing method according to claim 2, wherein at the soaking stage, the temperature of the steel sheet is controlled at 750-930° C., and a soaking time is controlled at 30-300 seconds.

* * * * *